US005927207A

United States Patent [19]

Ghosh et al.

[11] Patent Number: 5,927,207

[45] Date of Patent: Jul. 27, 1999

[54] ZIRCONIA CERAMIC IMAGING MEMBER WITH HYDROPHILIC SURFACE LAYER AND METHODS OF USE

[75] Inventors: Syamal K. Ghosh; Dilip K. Chatterjee, both of Rochester, N.Y.

[73] Assignee: Eastman Kodak Company, Rochester, N.Y.

[21] Appl. No.: 09/056,493

[22] Filed: Apr. 7, 1998

[51] Int. Cl.[6] ..... B41N 1/14; B41C 1/10

[52] U.S. Cl. ..... 101/455; 101/457; 101/467

[58] Field of Search ..... 101/453, 454, 101/455, 458, 459, 463.1, 465, 466, 467

[56] References Cited

U.S. PATENT DOCUMENTS

| | | | |
|---|---|---|---|
| 3,506,779 | 4/1970 | Brown et al. | 101/467 |
| 3,549,733 | 12/1970 | Caddell | 101/401.1 |
| 3,574,657 | 4/1971 | Burnett | 101/465 |
| 3,654,864 | 4/1972 | Ovshinsky | 101/426 |
| 3,793,033 | 2/1974 | Mukherjee | 101/456 |
| 3,832,948 | 9/1974 | Barker | 101/401.1 |
| 3,945,318 | 3/1976 | Landsman | 101/467 |
| 3,962,513 | 6/1976 | Eames | 101/463 |
| 3,964,389 | 6/1976 | Peterson | 101/467 |
| 4,034,183 | 7/1977 | Uhlig | 219/121.85 |
| 4,054,094 | 10/1977 | Caddell et al. | 101/467 |
| 4,081,572 | 3/1978 | Pacansky | 101/467 |
| 4,214,249 | 7/1980 | Kasai et al. | 101/467 |
| 4,334,006 | 6/1982 | Kitajima et al. | 430/254 |
| 4,687,729 | 8/1987 | Cadwell et al. | 101/463.1 |
| 4,693,958 | 9/1987 | Schwartz et al. | 430/302 |
| 4,731,317 | 3/1988 | Fromson et al. | 430/159 |
| 4,794,680 | 1/1989 | Meyerhoff et al. | 492/54 |
| 4,846,065 | 7/1989 | Mayrhofer et al. | 101/453 |
| 4,967,663 | 11/1990 | Metcalf | 101/348 |
| 5,045,697 | 9/1991 | Schneider | 347/224 |
| 5,238,778 | 8/1993 | Hirai et al. | 101/467 |
| 5,293,817 | 3/1994 | Nussel et al. | 101/453 |
| 5,317,970 | 6/1994 | Nussel et al. | 101/478 |
| 5,339,737 | 8/1994 | Lewis et al. | 101/454 |
| 5,345,869 | 9/1994 | Treverton et al. | 101/454 |
| 5,353,705 | 10/1994 | Lewis et al. | 101/453 |
| 5,378,580 | 1/1995 | Leenders | 430/303 |
| 5,385,092 | 1/1995 | Lewis et al. | 101/467 |
| 5,395,729 | 3/1995 | Reardon et al. | 430/200 |
| 5,454,318 | 10/1995 | Hirt et al. | 101/453 |
| 5,543,269 | 8/1996 | Chatterjee | 430/346 |
| 5,555,809 | 9/1996 | Hirt et al. | 101/451 |
| 5,713,287 | 2/1998 | Gelbart | 101/467 |
| 5,743,188 | 4/1998 | Ghosh et al. | 101/467 |
| 5,783,364 | 7/1998 | Ellis et al. | 101/467 |
| 5,807,658 | 9/1998 | Ellis et al. | 101/467 |

FOREIGN PATENT DOCUMENTS

| | | |
|---|---|---|
| 0 001 068 | 3/1979 | European Pat. Off. . |
| 531 878 A1 | 9/1992 | European Pat. Off. . |
| 0 573 091 A1 | 12/1993 | European Pat. Off. . |
| 0 693 371 A1 | 1/1996 | European Pat. Off. . |
| 0 769 372 A1 | 4/1997 | European Pat. Off. . |
| 44 42 235 A1 | 6/1995 | Germany . |

*Primary Examiner*—Stephen R. Funk
*Attorney, Agent, or Firm*—J. Lanny Tucker

[57] ABSTRACT

Long wearing lithographic imaging members are prepared from a zirconia ceramic layer having thereon a hydrophilic, non-crosslinked water-insoluble surface layer. This surface layer is ablatable using imaging apparatus such as a laser, and the surface energy differential between the non-removed hydrophilic layer and the exposed underlying zirconia ceramic is desirable to provide lithographic printing with improved image sharpness.

17 Claims, 1 Drawing Sheet

ZIRCONIA CERAMIC IMAGING MEMBER WITH HYDROPHILIC SURFACE LAYER AND METHODS OF USE

RELATED APPLICATIONS

Copending and commonly assigned U.S. Ser. No. 08/844,348, filed on Apr. 18, 1997, by Chatterjee et al, now U.S. Pat. No. 5,855,173, as a CIP of recently allowed U.S. Ser. No. 08/576,178, filed Dec. 21, 1995, now U.S. Pat. No. 5,743,188.

Copending and commonly assigned U.S. Ser. No. 08/844,292, filed on Apr. 18, 1997, by Chatterjee et al now U.S. Pat No. 5,839,370.

Copending and commonly assigned U.S. Ser. No. 08/843,522, filed on Apr. 18, 1997, by Chatterjee et al now U.S. Pat. No. 5,839,369.

Copending and commonly assigned U.S. Ser. No. 08/848,780, filed on May 1, 1997, by Ghosh et al.

Copending and commonly assigned U.S. Ser. No. 08/848,332, filed on May 1, 1997, by Chatterjee et al, now U.S. Pat. No. 5,836,249.

Copending and commonly assigned U.S. Ser. No. 08/850,315, filed on May 1, 1997, by Jarrold et al, now U.S. Pat. No. 5,836,248.

Copending and commonly assigned U.S. Ser. No. 09/004,118, filed on Jan. 7, 1998, by Ghosh et al.

FIELD OF THE INVENTION

This invention relates in general to lithography and in particular to new and improved lithographic imaging members. More specifically, this invention relates to novel imaging members having a zirconia ceramic layer and a hydrophilic surface layer, and to methods of imaging and printing using these imaging members.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket, which in turn transfers the ink to the surface of the material upon which the image is to be reproduced.

Aluminum has been used for many years as a support for lithographic printing plates. In order to prepare the aluminum for such use, it is typical to subject it to both a graining process and a subsequent anodizing process. The graining process serves to improve the adhesion of the subsequently applied radiation-sensitive coating and to enhance the water-receptive characteristics of the background areas of the printing plate.

Lithographic printing plates of the type described hereinabove are usually developed with a developing solution after being imagewise exposed. The developing solution, which is used to remove the non-image areas of the imaging layer and thereby reveal the underlying porous hydrophilic support, is typically an aqueous alkaline solution and frequently includes a substantial amount of organic solvent. The need to use and dispose of substantial quantities of alkaline developing solution has long been a matter of considerable concern in the printing art.

Efforts have been made for many years to manufacture a printing plate that does not require development with an alkaline developing solution. Examples of the many references relating to such efforts include, among others: U.S. Pat. No. 3,506,779 (Brown et al), U.S. Pat. No. 3,549,733 (Caddell), U.S. Pat. No. 3,574,657 (Burnett), U.S. Pat. No. 3,793,033 (Mukherjee), U.S. Pat. No. 3,832,948 (Barker), U.S. Pat. No. 3,945,318 (Landsman), U.S. Pat. No. 3,962,513 (Eames), U.S. Pat. No. 3,964,389 (Peterson), U.S. Pat. No. 4,034,183 (Uhlig), U.S. Pat. No. 4,054,094 (Caddell et al), U.S. Pat. No. 4,081,572 (Pacansky), U.S. Pat. No. 4,334,006 (Kitajima et al), U.S. Pat. No. 4,693,958 (Schwartz et al), U.S. Pat. No. 4,731,317 (Fromson et al), U.S. Pat. No. 5,238,778 (Hirai et al), U.S. Pat. No. 5,353,705 (Lewis et al), U.S. Pat. No. 5,385,092 (Lewis et al), U.S. Pat. No. 5,395,729 (Reardon et al), EP-A-0 001 068, and EP-A-0 573 091.

Lithographic printing plates designed to eliminate the need for a developing solution which have been proposed heretofore have suffered from one or more disadvantages that have limited their usefulness. For example, they have lacked a sufficient degree of discrimination between oleophilic image areas and hydrophilic non-image areas with the result that image quality on printing is poor. In addition, they have had oleophilic image areas which are not sufficiently durable to permit long printing runs, they have had hydrophilic non-image areas that are easily scratched and worm, or they have been unduly complex and costly by virtue of the need to coat multiple layers on the support.

Ceramic printing members, including printing cylinders are known. U.S. Pat. No. 5,293,817 (Nüssel et al), for example, describes porous ceramic printing cylinders having a printing surface prepared from zirconium oxide, aluminum oxide, aluminum-magnesium silicate, magnesium silicate or silicon carbide.

It has also been discovered that ceramic alloys of zirconium oxide and a secondary oxide that is MgO, CaO, $Y_2O_3$, $Sc_2O_3$ or a rare earth oxide are highly useful printing members, as described for example, in EP-A-0 769 372 and some of the copending and commonly assigned US applications noted above.

A zirconia ceramic having a stoichiometric composition is hydrophilic in nature. Transforming the zirconia ceramic, such as during thermal imaging, into a substoichiometric composition, renders the ceramic more oleophilic. The total surface energy change from such transformations is about 6 or 7 dynes/cm, which is sufficient to create a good image. However, image quality could be improved substantially if the surface energy differential between the imaged and non-imaged areas could be made even larger.

While the zirconia ceramic imaging members described above are highly useful, and have a number of advantages over conventional materials, there is a need to provide ceramic imaging members having a greater surface energy differential between imaged and non-imaged areas on the printing surface.

SUMMARY OF THE INVENTION

This invention provides an imaging member comprising a zirconia ceramic layer, and a hydrophilic, non-crosslinked, water-insoluble, surface layer composed of an inorganic oxide matrix, the hydrophilic surface layer having a surface energy of at least 50 dynes/cm.

This invention also provides a method of imaging comprising the steps of:

A) providing the imaging member described above, and

B) imagewise ablating the hydrophilic surface layer.

Further, this invention also provides a method of printing comprising the steps of:

A) providing the imaging member described above,

B) imagewise ablating the hydrophilic surface layer,

C) contacting the imaged imaging member with a lithographic printing ink, and

D) imagewise transferring the printing ink to a receiving material.

The imaging members of this invention have a number of advantages. For example, no chemical processing is required so that the effort, expense and environmental concerns associated with the use of aqueous alkaline developing solutions are avoided. Post-exposure baking or blanket exposure to ultraviolet or visible light sources, as are commonly employed with many lithographic printing plates, are not required. Imagewise exposure of the imaging member can be carried out directly, for example, with a focused laser beam that ablates the hydrophilic surface layer in an imagewise fashion, leaving exposed areas of zirconia ceramic, and non-exposed areas of hydrophilic surface layer. The surface energy differential between those two surfaces is a desirable increase over conventional materials. In particular, this differential should be at least 8 dynes/cm.

Exposure with a laser beam enables the imaging member to be imaged directly from digital data, and used in printing, without the need for intermediate films and conventional time-consuming optical printing methods. Since no chemical processing, wiping, brushing, baking or treatment of any kind is required, it is feasible to expose the imaging member directly on the printing press by equipping the press with a laser exposing device and suitable means for controlling the position of the laser exposing device.

A still further advantage is that the imaging member is well adapted to function with conventional fountain solutions and/or conventional lithographic printing inks so that no novel or costly chemical compositions are required.

The zirconia ceramic underlayer utilized in this invention has many characteristics that render it especially beneficial for use in lithographic printing. Thus, for example, it provides durability, abrasion-resistance, and long wearability. Because of the increased hydrophilicity in the non-imaged areas (i.e., the hydrophilic surface layer), discrimination between oleophilic imaged areas and hydrophilic non-imaged areas is excellent. The imaging member can be of several different forms (described below) and thus can be flexible, semi-rigid or rigid. Its use in imaging and printing is fast and easy to carry out, image resolution is very high and imaging is especially well suited to images that are electronically captured and digitally stored.

DETAILED DESCRIPTION OF THE INVENTION

Figure 1:
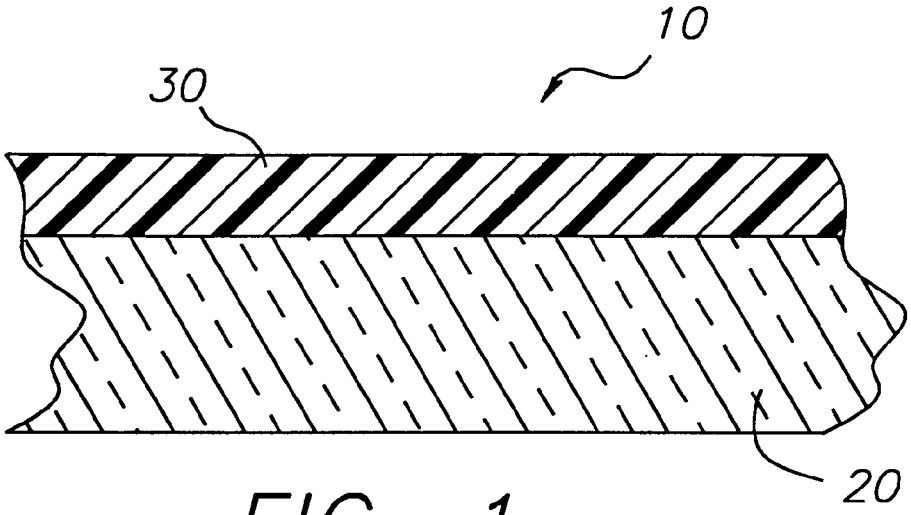
FIG. 1 is a partial cross-sectional view of an imaging member of this invention prior to imaging.

The imaging member of this invention comprises a zirconia (or alloy) layer composed predominantly of zirconia (or an alloy described below) of stoichiometric ($ZrO_2$) composition. The zirconia ceramic layer serves as the imaged areas since the hydrophilic surface layer is imagewise ablated. The imaged areas then provide more oleophilic surfaces than the non-imaged areas and will therefore take a lithographic ink more readily.

The zirconia layer can be composed simply of zirconia oxide. Alternatively, the zirconia layer comprises a composite of zirconia and alumina ($Al_2O_3$). In such embodiments, the zirconia comprises at least 50% (by weight) of the ceramic. Preferably, the zirconia comprises from about 50 to about 99.9%, and more preferably from about 70 to about 90% (by weight) of the ceramic. The alumina within the composite is in the rhombhedral form or phase (this may be indexed as hexagonal by a crystallographer), and is known as $\alpha$-alumina. Zirconia-alumina compositions can also be prepared using the zirconia alloys described below.

In a preferred embodiment, the zirconia ceramic is an alloy comprising a secondary oxide selected from the group consisting of MgO, CaO, $Y_2O_3$, $Sc_2O_3$, rare earth oxides (such as $Ce_2O_3$, $Nd_2O_3$ and $Pr_2O_3$), and combinations and mixtures of any of these secondary oxides. The secondary oxide can also be referred to as a dopant. The preferred dopant is $Y_2O_3$. The dopant provides high strength and enhanced fracture toughness.

The molar ratio of secondary oxide (dopant) to zirconium oxide preferably ranges from about 0.1:99.9 to about 25:75, and is more preferably from about 0.5:99.5 to about 5:95 when the dopant is yttria.

The zirconia used in any embodiment of this invention can be of any crystalline form or phase including the tetragonal, monoclinic and cubic crystalline forms, or mixtures of any two or more of such forms or phases. The tetragonal form is predominantly used because of its high fracture toughness especially in the alloys and composites including yttria as the secondary oxide.

The hydrophilic, non-crosslinkable, water-insoluble surface layer can be provided on the zirconia ceramic layer in a number of ways. Preferably, it is directly applied, but can also be applied to an intermediate layer that is also ablated during imaging.

In one embodiment, the hydrophilic surface layer can be composed of a matrix of one or more inorganic oxides, such as silica, titania, silica-titania, silica-alumina, and titania-alumina matrices. These materials can be applied as dispersions and dried to form a water-insoluble layer, with or without a binder material that can be burned away after the dispersion is applied to the ceramic layer. For example, a thin layer of silica, or a silica-titania composite, can be applied by physical vapor deposition, chemical vapor deposition or thermal spray. Other techniques, such as dip, spray, knife or rod coating, can also be used.

Preferably, one or more binder materials are used to adhere or coalesce the oxide particles after coating and drying. These organic binder materials are not crosslinkable, but provide a physical bonding among the oxide particles. Such binder materials include, but are not limited to, polyvinyl alcohol, polyalkylene glycols (such as polyethylene glycols), polyacrylates and polymethacrylates. A preferred binder material is polyvinyl alcohol. The amount of binder used in such formulations can be at least 3 weight % of the total hydrophilic composition before it is dried.

In a preferred embodiment, the hydrophilic layer inorganic matrix is formed from one or more colloids of beryllium, magnesium, silicon, arsenic, indium, tin, antimony, tellurium, lead, titanium, bismuth or a transition metal oxide. Aluminum oxide is not useful for this purpose when used alone. Such colloids are often called "sol gels" or colloidal sols. Colloids of silicon, titanium and zirconium oxides are preferred, and a colloid of silicon or mixture of silicon and titanium are most preferred. Such colloids can be obtained from hydroxysilicates, hydroxytitanates and hydroxyzirconates. Methods for forming these colloids are described in U.S. Pat. No. 2,244,325, U.S. Pat. No. 2,574,902 and U.S. Pat. No. 2,597,872, incorporated herein by reference. Stable dispersions of such materials can be purchased from various sources including DuPont Company. The hydrophilic layer is most effective when it contains a minimum amount of hydrophobic groups such as methyl or other alkyl groups. The hydrophilic layer preferably should contain less than 5% hydrocarbon groups by weight.

The hydrophilic layer can also include addenda such as surfactants, dyes, and colorants for coatability, visibility and improved light absorption.

This layer has a critical thickness so the energy levels required for ablation imaging are not too high. Thus, the dry thickness is from about 0.05 to about 1 $\mu$m, and preferably from about 0.075 to about 0.1 $\mu$m. This layer also has a surface energy of at least 50 dynes/cm, preferably at least 55 dynes/cm, and more preferably at least 60 dynes/cm.

Surface energy can be measured by conventional methods. One useful method involves the use of Fowkes Analysis. In this, the contact angles between a set of fluids and the clean surfaces of the materials being evaluated are measured. More specifically, the contact angles were measured on the bare zirconia ceramic and the hydrophilic layer using a Rame-Hart contact angle goniometer. The test fluids used for these measurements were double deionized water for the polar part and diiodomethane (or methylene iodide) for the dispersive part of the total surface energy. The average static contact angle for each test fluid was measured by placing an approximately 7.5 $\mu$l drop of the fluid on the sample, and using the goniometer when the fluid was at an equilibrium state (that is, when the fluid no longer advances along the surface).

The imaging members of this invention can be of any useful form including, but not limited to, printing plates, printing cylinders, printing sleeves, and printing tapes (including flexible printing webs). The imaging member can include the zirconia ceramic and hydrophilic surface layers disposed on a suitable substrate material, often known as a support. Useful support materials include metals, polymeric films, glass and non-zirconia ceramics.

Printing plates can be of any useful size and shape (for example, square or rectangular). Printing cylinders and sleeves are described, for example, in the noted application, U.S. Ser. No. 08/844,348 of Chatterjee, Ghosh and Nüssel. Hollow or solid steel or aluminum cores can be used as substrates if desired. Such printing members can be prepared using methods described above for the printing plates, or fitted around another less expensive metal core. Printing tapes can be formed either on a rigid or semi-rigid substrate to form a composite with the zirconia ceramic and hydrophilic surface layers. In addition, the printing tapes of this invention, in the form of a continuous web, enable a user to use different segments of the tape for different images. The tape would therefore provide continuity within the "same printing job" even if the images differed. The user need not interrupt the work to change conventional printing plates in order to provide different printed images.

The zirconia alloys and composites useful herein, and methods of manufacturing are in more detail in the noted copending applications described above, and U.S. Pat. No. 5,290,332 (Chatterjee et al), U.S. Pat. No. 5,336,282 (Ghosh et al) and U.S. Pat. No. 5,358,913 (Chatterjee et al), incorporated herein by reference for such methods of manufacture. The density and porosity of the zirconia ceramic can be varied by adjusting their consolidating parameters, such as pressure and sintering temperature.

Thermal or plasma spray and chemical vapor deposition (CVD) and physical vapor deposition (PVD) can be carried out using conventional procedures, either in air or in an oxygen environment to produce hydrophilic layers on ceramic surfaces.

The imaging member of this invention may be formed using a sol-gel dispersion, and may also be subjected to a heating step after the hydrophilic surface layer is formed, and before imaging. This heating can be used to "bum away" the organic additives and solvents (including binders), and to otherwise densify the inorganic oxide matrix. Heating is generally at a temperature of at least 200° C. for a few minutes up to an hour.

The imaging members of this invention can be imaged by any suitable technique on any suitable equipment, such as a plate setter or printing press. In one embodiment, the essential requirement is imagewise exposure to radiation which is effective to ablate the hydrophilic surface layer, leaving the zirconia ceramic exposed in imaged areas. Thus, the imaging members can be imaged by exposure through a transparency or can be exposed from digital information such as by the use of a laser beam. Preferably, the imaging members are directly laser written. The laser, equipped with a suitable control system, can be used to "write the image" or to "write the background."

For imaging, it is preferred to utile a high-intensity laser beam with a power density at the printing surface of from about $30\times10^6$ to about $850\times10^6$ watts/cm$^2$ and more preferably from about $75\times10^6$ to about $425\times10^6$ watts/cm$^2$. However, any suitable exposure to electromagnetic radiation of an appropriate wavelength can be used as long as ablation of the hydrophilic surface layer on the ceramic layer occurs.

An especially preferred laser for use in imaging the imaging member of this invention is an Nd:YAG laser that is Q-switched and optically pumped with a krypton arc lamp. The wavelength of such a laser is 1.064 $\mu$m.

The conditions of laser exposure are controlled to "ablate", burn away or loosen a portion of the hydrophilic surface layer in the exposed regions. Thus, a pit is formed in the exposed regions from the removal of "ablated" hydrophilic surface layer. If the hydrophilic surface layer is very thin, ablation may also remove or melt part of the zirconia ceramic layer, and may render it even more oleophilic. The preferred laser imaging conditions for this method are as follows:

Laser Power: Continuous wave average—0.1 to 50 watts, preferably from 0.5 to 30 watts, Peak power (Q-switched)—6,000 to $10^5$ watts, preferably from 6,000 to 70,000 watts, Power density—$30\times10^6$ to $850\times10^6$ W/cm$^2$, preferably from $75\times10^6$ to $425\times10^6$ W/cm$^2$, Spot size in $TEM_{00}$ mode=100 $\mu$m, Current=18 to 24 amperes, preferably from 19 to 24 amperes, Laser energy=$6\times10^{-4}$ to $5.5\times10^{-3}$ J, preferably from $6\times10^{-4}$ to $3\times10^{-3}$ J, Energy density=5 to 65 J/cm$^2$, preferably from 7 to 40 J/cm$^2$, Pulse Rate=0.5 to 50 kHz, preferably from 1 to 30 kHz, Pulse Width=50 to 300 nsec, preferably from 80 to 150 nsec, Scan Field=11.5×11.5 cm, Scan Velocity=no more than 3 m/sec, Repeatability in pulse to pulse jitter=about 25% at high Q-switch rate (about 30 kHz), <10% at low Q-switch rate (about 1 kHz).

FIG. 1 shows an imaging member 10 of this invention comprising zirconia ceramic layer 20 and hydrophilic surface layer 30, prior to imaging.

Figure 2:
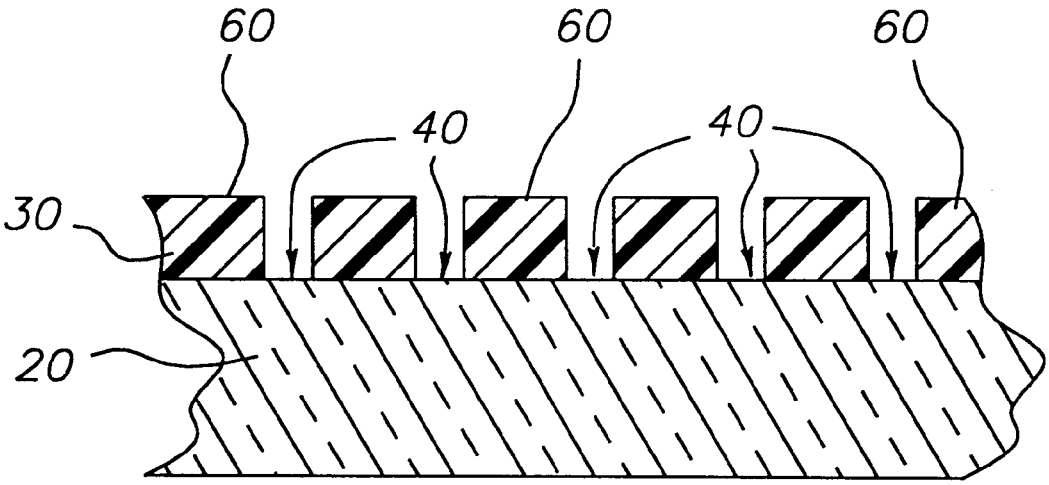
FIG. 2 is a partial cross-sectional view of an imaging member of this invention after imaging.

In FIG. 2, the same imaging member is shown after imaging, and hydrophilic surface layer 30 has been removed in exposed (imaged) areas 40, leaving non-imaged areas 60.

The invention is further illustrated by the following examples of various useful printing members.

EXAMPLE 1

Colloidal sol-gel compositions containing either synthethized tetraethyl silicate or tetraisopropyl titanate were obtained from Petrarch Systems, Inc. (Bristol, Pa.). These compositions contained 5 weight % solids. They were combined (20:80 titania to silica) with stirring at 40° C. for 30–45 minutes. The dispersion was cooled to room temperature, filtered and stored in a refrigerator until used.

Thin (about 0.050 to 0.075 micrometer thickness) coatings of the noted sol-gel mixture were made on zirconia ceramic substrates using a Headway spin coater at 2,000–5,000 rpm for 15 to 60 seconds. These substrates were composed of zirconia alloyed with 3 mol % yttria (prepared from powder obtained from Zirconia Sales of America, Atlanta, Ga.). The faster the coating speed, the thinner the coatings. The coated members were then heated in an air furnace at about 275° C. for 30–45 minutes.

Polar and dispersive surface energy measurements were made using a Rame-Hart, Inc. goniometer to measure the contact angles of water and methylene iodide of the coated hydrophilic layer. The hydrophilic surface layer having a mixture of titania and silica was determined to have a total surface energy of 64 dynes/cm.

EXAMPLE 2

Another imaging member of this invention was prepared similar to that described in Example 1 except solely a silica sol-gel was applied to the zirconia ceramic surface. After heating, the total surface energy measurement of the hydrophilic surface layer was determined to be 52 dynes/cm.

EXAMPLE 3 AND COMPARATIVE EXAMPLE 1

The imaging members described in Examples 1 and 2 were imagewise exposed to laser imaging at 1.06 $\mu$m wavelength using an Nd:YAG laser under the conditions shown in Table I. A Comparative Example 1 imaging member comprising an uncoated zirconia substrate was also exposed to the laser. The resulting surface energies of the hydrophilic surface layer are also shown in Table I below.

Before imaging, the bare zirconia ceramic of the Comparative Example 1 imaging member had a total surface energy of 48 dynes/cm, and upon imaging the total surface energy had changed to 41 dynes/cm. The results from imaging are also shown in Table I. The surface energy differential between the Example 2 non-imaged areas and the imaged areas was 11 dynes/cm, which is desirably larger than the differential between non-imaged and imaged areas of uncoated zirconia (7 dynes/cm). The differential in the imaged member of Example 1 was even higher, 23 dynes/cm. It also appears that the imaging current is critical, that is it must be above 18 amperes.

COMPARATIVE EXAMPLE 2

The imaging members described in Examples 1 and 2 hereinabove were imagewise exposed to laser imaging at 1.06 $\mu$m wavelength using an Nd:YAG laser under the condition shown in Table 1 below.

The surface energy of the silica sol-gel coated zirconia ceramic had a surface energy of 52 dynes/cm, and upon irradiation at 15 Amp current and 0.1 watt laser power, it was not possible to ablate the thin sol-gel coating to effectively image the zirconia substrate underneath.

TABLE I

| MEMBER | PULSE RATE | CURRENT | SCAN VELOCITY | LASER POWER | SURFACE ENERGY | IMAGING RESULTS |
|---|---|---|---|---|---|---|
| Example 2 | 1 kHz | 22 Amp | 50 m/sec | 2.2 watts | 52 dynes/cm | Good image |
| Example 1 | 1 kHz | 19 Amp | 50 m/sec | 1.0 watt | 64 dynes/cm | Good image |
| Comparative Example 1 | 1 kHz | 19 Amp | 50 m/sec | 1.0 watt | 41 dynes/cm | Good image |
| Comparative Example 2 | 1 kHz | 15 Amp | 50 m/sec | 0.1 watt | 52 dynes/cm | No image |

The invention has been described in detail with particular reference to preferred embodiments thereof, but it will be understood that variations and modifications can be effected within the spirit and scope of the invention.

We claim:

1. An imaging member comprising a zirconia ceramic layer, and a hydrophilic, non-crosslinked, water-insoluble surface layer composed of an inorganic oxide matrix, said hydrophilic surface layer having a surface energy of at least 50 dynes/cm.

2. The imaging member of claim 1 wherein said inorganic oxide matrix comprises silica, silica-titania, silica-alumina or titania-alumina.

3. The imaging member of claim 2 wherein said inorganic oxide matrix further comprises an organic polymer binder.

4. The imaging member of claim 1 wherein said inorganic oxide matrix comprising a colloid of beryllium, magnesium, silicon, arsenic, indium, tin, antimony, tellurium, lead, titanium, bismuth or a transition metal oxide.

5. The imaging member of claim 4 wherein said inorganic oxide matrix comprises a colloid of silicon, or a mixture of silicon and titanium oxides.

6. The imaging member of claim 1 wherein said hydrophilic surface layer has a surface energy of at least 55 dynes/cm.

7. The imaging member of claim 6 wherein said hydrophilic surface layer has a surface energy of at least 60 dynes/cm.

8. The imaging member of claim 1 wherein said zirconia ceramic is composed of an alloy of zirconium oxide and a secondary oxide selected from the group consisting of MgO, CaO, $Y_2O_3$, $Sc_2O_3$, a rare earth oxide, and a combination of any of these oxides.

9. The imaging member of claim 8 wherein said zirconia ceramic is a zirconia-yttria alloy.

10. The imaging member of claim 1 wherein said zirconia ceramic is a zirconia-alumina composition comprising from about 70 to about 90%, by weight of zirconia.

11. The imaging member of claim 1 wherein said hydrophilic surface layer has a dry thickness of from about 0.05 to about 1 $\mu$m.

12. The imaging member of claim 11 wherein said hydrophilic surface layer has a dry thickness of from about 0.075 to about 0.1 $\mu$m.

13. An imaging member comprising a zirconia ceramic layer, and a hydrophilic, non-crosslinked, surface layer composed of an inorganic oxide matrix, said hydrophilic surface layer having a surface layer having a surface energy of at least 50 dynes/cm, said imaging member having been prepared by:

applying a layer of an inorganic oxide to a zirconia ceramic substrate to form a laminate of said zirconia ceramic substrate and a hydrophilic surface layer, and heating said laminate at a temperature of at least 200° C. for sufficient time to form a water-insoluble, inorganic oxide matrix in said hydrophilic surface layer.

14. A method of imaging comprising the steps of:

A) providing an imaging member, a zirconia ceramic layer, and a hydrophilic, non-crosslinked, water-insoluble surface layer composed of an inorganic oxide matrix said hydrophilic surface layer having a surface energy of at least 50 dynes/cm, and B) imagewise ablating said hydrophilic surface layer.

15. The method of claim 14 wherein said image is provided on said hydrophilic surface layer by ablation using the following laser imaging conditions:

an average power level of from about 0.1 to about 50 watts, a peak power of from about 6,000 to about 100,000 watts (in Q-switched mode), current of from 18 to 24 amperes, a pulse rate of no more than 50 kHz, an average pulse width of from about 50 to about 300 nsec, and a scan velocity of no more than 3 m/sec.

16. The method of claim 15 wherein imaging current is from 19 to 24 amperes.

17. A method of printing comprising the steps of:

A) providing an imaging member, a zirconia ceramic layer, and a hydrophilic, non-crosslinked, water-insoluble surface layer composed of an inorganic oxide matrix said hydrophilic surface layer having a surface energy of at least 50 dynes/cm, B) imagewise ablating said hydrophilic surface layer, C) contacting the imaged imaging member with a lithographic printing ink, and D) imagewise transferring said printing ink to a receiving material.

* * * * *